US005588855A

United States Patent [19]

Nankoh

[11] Patent Number: 5,588,855

[45] Date of Patent: Dec. 31, 1996

[54] CONNECTOR

[75] Inventor: Yuichi Nankoh, Yokkaichi, Japan

[73] Assignee: Sumitomo Wiring Systems, Ltd., Yokkaichi, Japan

[21] Appl. No.: 419,422

[22] Filed: Apr. 10, 1995

[30] Foreign Application Priority Data

Apr. 20, 1994 [JP] Japan ..... 6-106086

[51] Int. Cl.[6] ..... H01R 31/08

[52] U.S. Cl. ..... 439/188; 439/509; 439/510; 439/511; 439/512; 439/513

[58] Field of Search ..... 439/733.1, 509, 439/510, 511, 512, 513, 188

[56] References Cited

U.S. PATENT DOCUMENTS

| | | | |
|---|---|---|---|
| 4,772,229 | 9/1988 | Nix et al. | 439/733.1 |
| 4,884,978 | 12/1989 | Inaba et al. . | |
| 5,145,356 | 9/1992 | Minnis | 439/489 |
| 5,376,017 | 12/1994 | Taniuchi et al. | 439/489 |
| 5,391,087 | 2/1995 | Fukuda | 439/188 |
| 5,462,449 | 10/1995 | Tsuji et al. | 439/188 |
| 5,464,353 | 11/1995 | Saijo et al. | 439/188 |
| 5,464,356 | 11/1995 | Nebeshima et al. | 439/733.1 |

FOREIGN PATENT DOCUMENTS

| | | | |
|---|---|---|---|
| 624930 | 11/1994 | European Pat. Off. | 439/509 |
| 6181083 | 11/1994 | Japan | 439/509 |

*Primary Examiner*—Stephen P. Garbe
*Attorney, Agent, or Firm*—Anthony J. Casella; Gerald E. Hespos

[57] ABSTRACT

When a short-circuit terminal 4 is inserted into a 22, a first engaging projection 46 formed in the terminal 4 is engaged with an engaging member 24, thereby realizing first engagement. Thereafter, when a retainer 5 is pressed to its main locking position, a second engaging projection 48 of the terminal 4 is engaged with the rear edge of guide surfaces 55, thereby realizing second engagement. The terminal 4 can be securely locked in the cavity 22 by the two engaging mechanisms. At the same time, supply terminals 3 are also doubly locked in cavities 21.

11 Claims, 6 Drawing Sheets

CONNECTOR

BACKGROUND OF THE INVENTION

1. Field of the Invention

The present invention relates to a connector and, particularly to a connector provided with a short-circuit terminal having an improved locking mechanism.

2. Description of the Prior Art

In an electric circuit for activating an apparatus such as an air bag which cannot be used repeatedly, it is necessary to avoid an erroneous operation of the apparatus when maintaining and inspecting its circuit system or conducting wiring. Accordingly, in a state where a short-circuit terminal is mounted in an apparatus side connector housing and the apparatus side connector housing is detached from a supply side connector housing, (+)- and (−)-supply terminals are short-circuited by the short-circuit terminal. Thus, an undesirable event is prevented where an induced current caused by external magnetic and/or electric fields could otherwise flow into the circuits provided in the apparatus and cause the erroneous operation of the apparatus.

A connector shown in FIG. 7 is known as an example of connectors provided with such a short-circuit terminal. A supply side connector housing 91 and an apparatus side connector housing 90 are coupled by rotating a lever 92 provided in the supply side connector housing 91. In the apparatus side connector housing 90, two supply terminals 93 are mounted in cavities 93*a* formed side by side, and a short-circuit terminal 94 is mounted in a cavity 94*a*. Without exerting an external force thereto, the short-circuit terminal 94 mounted in the cavity 94*a* comes into contact with the lower surfaces of the supply terminals 93, thereby short-circuiting the supply terminals 93.

The short-circuit terminal 94 includes supports 95, elastic arms 96 extending forward from the corresponding supports 95, and a connecting portion 97 for connecting the leading ends of the arms 96, and is mounted such that the connecting portion 97 comes into contact with the lower surfaces of the two supply terminals 93. A projection 95*a* formed at each support 95 by cutting and bending a part of the support 95 engages an unillustrated engaging member formed in the cavity 94*a*, thereby locking the short-circuit terminal 94 in the cavity 94*a*. The short-circuit terminal 94 is mounted by being inserted backward from the front face of the apparatus side connector housing 90 to a position where the projection 95*a* engages the engaging member of the cavity 94*a*.

When the apparatus side connector housing 90 is fitted in and coupled with the supply side connector housing 91 by rotating the lever 92, a pressing portion 92*a* projecting from the inner surface of the lever 92 presses the connecting portion 97, thereby electrically separating the supply terminals 93 from each other and releasing a short-circuited state.

In the prior art short-circuit terminal 94, the projections 95*a* formed at one end thereof engage the engaging member formed in the cavity 94*a* to lock the short-circuit terminal 94 in the cavity 94*a*. When the apparatus side connector housing 90 mounted in a wiring harness is subjected to vibrations or impacts during transportation, the projections 95*a* may be disengaged from the engaging member, thereby causing improper mounting of the short-circuit terminal 94 as shown in FIG. 8.

The short-circuit terminal 94 is mounted by being inserted backward from the front face of the apparatus side connector housing 90. Insufficient insertion also causes improper mounting of the short-circuit terminal 94 as shown in FIG. 8. If the apparatus side connector housing 90 is coupled with the supply side connector housing 91 with the projections 95*a* disengaged from the engaging member, coupling is made although the connecting portion 97 is not pressed by the pressing portion 92*a*. In other words, the connector housings 90 and 91 are coupled without releasing the short-circuited state, bringing about a situation where the apparatus does not operate.

In view of the above problem, an object of the invention is to provide a connector capable of securely mounting a variety of terminals, particularly supply terminals and a short-circuit terminal, so that an apparatus connected with the connector housing can properly operate.

Another object is, in addition to the above object, to provide a retainer capable of securely mounting terminals, particularly supply terminals at their proper positions and to provide a connector having a more simple construction.

Another object is to provide a connector capable of detecting improper mounting of a short-circuit terminal.

SUMMARY OF THE INVENTION

The subject invention is directed to a connector with a retainer that provides for a mounting of the different terminals, which is more secure than the mounting provided by the prior art engagement between terminals and cavities.

Preferably, the terminals of the subject connector comprise respective first engaging portions which are additionally engageable with the respective cavities and second engaging portion which is engageable with the retainer. When a short-circuit terminal is inserted into the cavity therefor, the first engaging portion formed in the short-circuit terminal is engaged with the cavity for the short-circuit terminal, thereby realizing first engagement. Thereafter, when the retainer is pressed into the cavity for the short-circuit terminal transversely of the longitudinal direction thereof, the retainer engages the second engaging portion formed in the short-circuit terminal, thereby realizing second engagement. The short-circuit terminal can be securely locked in the cavity therefor by realizing the first and second engagements (double lock).

Thus, when the retainer is pressed into the cavity for the short-circuit terminal transversely of the longitudinal direction thereof, it not only realizes the second engagement for the short-circuit terminal, but also engages the supply terminals in their corresponding cavities, thereby securely locking the supply terminals.

Conclusively, a connector having a simple construction is obtainable since a single retainer is simultaneously engageable both with the short-circuit terminal and with the supply terminals.

Preferably, if either of the first engaging portions does not engage the cavity due to insufficient insertion of the respective terminals into the cavities therefor, i.e., the first engagement is not realized, the retainer being pressed comes into contact with this terminal and therefore cannot enter the cavity for the terminal. In this way, improper mounting of the terminal can be detected.

Thus, upon detection of the improper mounting of the retainer, the short-circuit terminal can be inserted again.

BRIEF DESCRIPTION OF THE DRAWINGS

These and other objects, features and advantages of the present invention will become more apparent upon a reading of the following detailed description and accompanying drawings in which.

DETAILED DESCRIPTION OF THE PREFERRED EMBODIMENT

Hereafter, one embodiment of the invention is described with reference to FIGS. 1 to 6.

Figure 1:
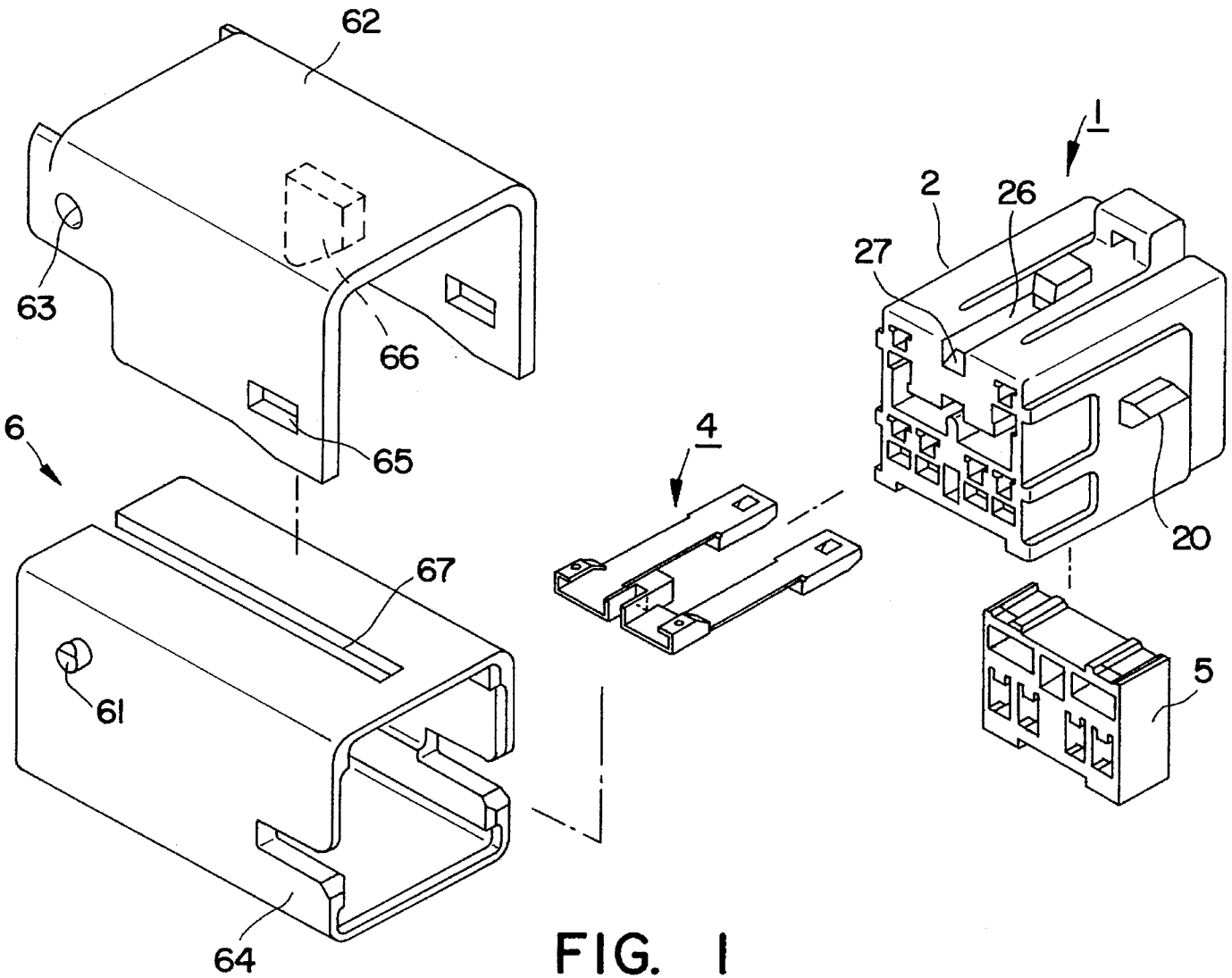
FIG. 1 is an exploded perspective view.

As shown in FIG. 1, a connector of this embodiment includes an apparatus side connector housing 1 to be connected with an unillustrated apparatus such as an air bag, and a supply side connector housing 6 to be connected with an unillustrated power source. A coupling member or movable member 62 is rotatably mounted on the connector 6 by fitting shafts 61 thereof into holes 63 formed in the coupling member 62. Unillustrated male supply terminals are projectingly mounted in a receptacle 64 of the housing 6. When the coupling member 62 is rotated toward its coupling position after the apparatus side connector housing 1 is fitted into the supply side connector housing 6, locking projections 20 formed on the apparatus side connector housing 1 are fitted into locking holes 65, thereby coupling the housings 1 and 6. As the coupling member 62 is rotated toward its coupling position, a pressing member 66 formed on the inner surface of the coupling member 62 comes into engagement with the apparatus side connector housing 1 through a groove 67 formed in the receptacle 64.

The apparatus side connector housing 1 includes a housing main body 2, two female supply terminals 3 (see FIG. 2) cramped at ends of wires W to be connected with the apparatus, a short-circuit terminal 4 which comes into contact with the supply terminals 3 to short-circuit them, and a retainer 5 for lockingly retaining the supply terminals 3 and the short-circuit terminal 4.

Figure 2:
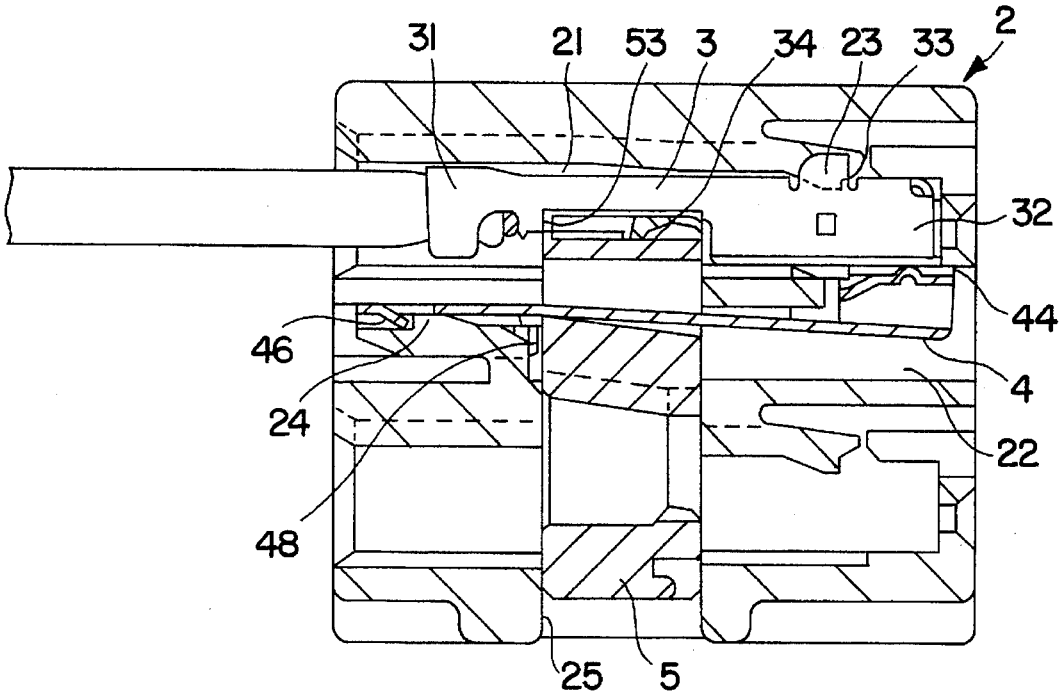
FIG. 2 is a longitudinal vertical section of an apparatus side connector housing in its main locking position.

As shown in FIG. 2, in the housing main body 2, there are formed cavities 21 for the supply terminals 3 and a cavity 22 for the short-circuit terminal 4 vertically at different stages. Each cavity 21 is formed with an engaging member or lance 23 which is engageable with the corresponding supply terminal 3 to be inserted from the rear side of the housing main body 2 (first engagement). Similarly, the cavity 22 is formed with an engaging member or lance 24 which is engageable with the short-circuit terminal 4 to be inserted from the front side of the housing main body 2 (first engagement).

Figure 3:
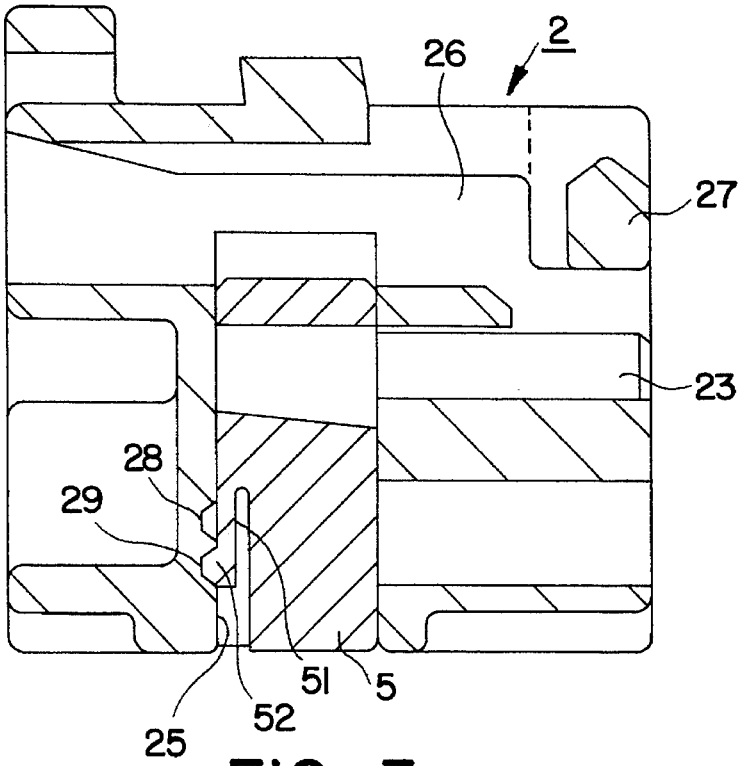
FIG. 3 is a central longitudinal vertical section of the apparatus side connector housing in its temporary locking position, taken along a vertical plane (in the lateral center) of the apparatus side connector housing.

In the lower part of the housing main body 2, there is formed a mount hole 25 in communication with the cavities 21. The retainer 5 is insertable upward into the mount hole 25. As shown in FIG. 3, a main locking recess 28 and a temporary locking recess 29 are formed in vertical relationship in the inner surface of the mount hole 25.

At the upper surface of the housing main body 2, there are formed an opening 26 (see FIG. 1) into which the pressing portion 66 is inserted, and an engaging portion 27 which is formed at a front end of the opening 26 and engageable with the pressing portion 66. When the coupling member 62 is rotated toward the locking position, the pressing portion 66 enters the opening 26, thereby pressing a portion 45 of the short-circuit terminal 4 to be described later.

Each female supply terminal 3 is formed at its base end with a barrel portion 31 to be cramped with an end of a wire W and at its leading end with an engaging portion 32 for engagement with an unillustrated male supply terminal. A first engaging portion 33 engageable with the engaging member 23 and a second engaging portion 34 engageable with the upper surface of the retainer 5 are formed on the upper and lower surfaces of the supply terminal 3 intermediate the portions 31 and 32, respectively.

Figure 4:
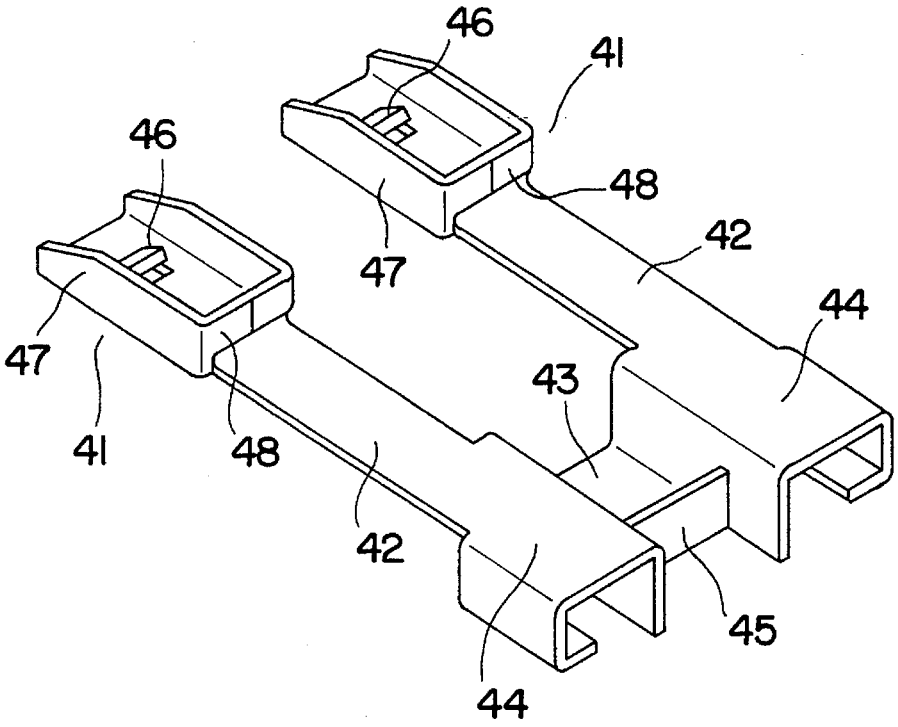
FIG. 4 is a perspective view of a short-circuit terminal.

As shown in FIG. 4, the short-circuit terminal 4 is formed by folding a thin conductive metal plate material. The terminal 4 includes two supports 41, 41 at its rear end, two elastic arms 42, 42 extending forward from the corresponding supports 41, 41 and a connecting portion 43 for connecting front ends of the arms 42, 42. When viewed from above, the terminal 4 is substantially in the form of a U-shape. At the front ends of respective arms 42, 42, there are formed contact portions 44 which come into contact with the lower surfaces of the corresponding supply terminals 3 to short-circuit these terminals 3. At the front end of the connecting portion 43 between the contact portions 44, 44, there is formed the portion 45 with which the pressing portion 66 of the coupling member 62 comes into pressing contact. A first engaging projection 46 (first engaging portion) is formed in each support 41 by cutting and bending a part of the support 41. Opposite lateral sides of each support 41 are bent downward to form side walls 47, and front ends of the side walls 47 (short-circuit terminal 4 is shown upside down in FIG. 4) are bent inward to form a second engaging projection (second engaging portion) 48.

As seen from FIG. 2, the thus formed short-circuit terminal 4 is inserted into the cavity 22 from the front end of the housing main body 2 and, in its completely mounted position, the first engaging projections 46 formed in the supports 41 are engaged with the engaging members 24.

Figure 5:
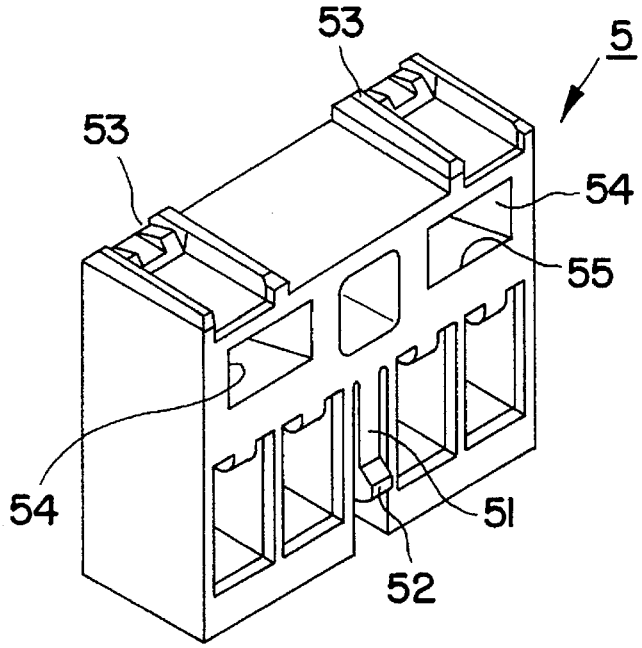
FIG. 5 is a perspective view of a retainer.

The retainer 5 is substantially in the form of such a rectangular parallelepiped that it is insertable into the mount hole 25. As shown in FIGS. 3 and 5, an elastic arm 51 formed with an engaging projection 52 at its leading end extends downward at the rear side of the retainer 5. The engaging projection 52 is engageable with the temporary or main locking recess 29 or 28. The retainer 5 has two locking positions: a temporary locking position where the projection 52 is engaged with the temporary locking recess 29 and the retainer does not block insertion and detachment of the supply terminals 3 and the short-circuit terminal 4, and a main locking position where the projection 52 is engaged with the main locking recess 28 and the retainer 5 engages the terminals 3 and 4.

On the upper surface of the retainer 5, there are formed second engaging portions 53 which project into the cavities 21 from below in the main locking position of the retainer 5 as shown in FIG. 2. In an intermediate portion of the retainer 5, there are formed insertion holes 54 which are substantially in conformity with the cavity 22.

Figure 6:
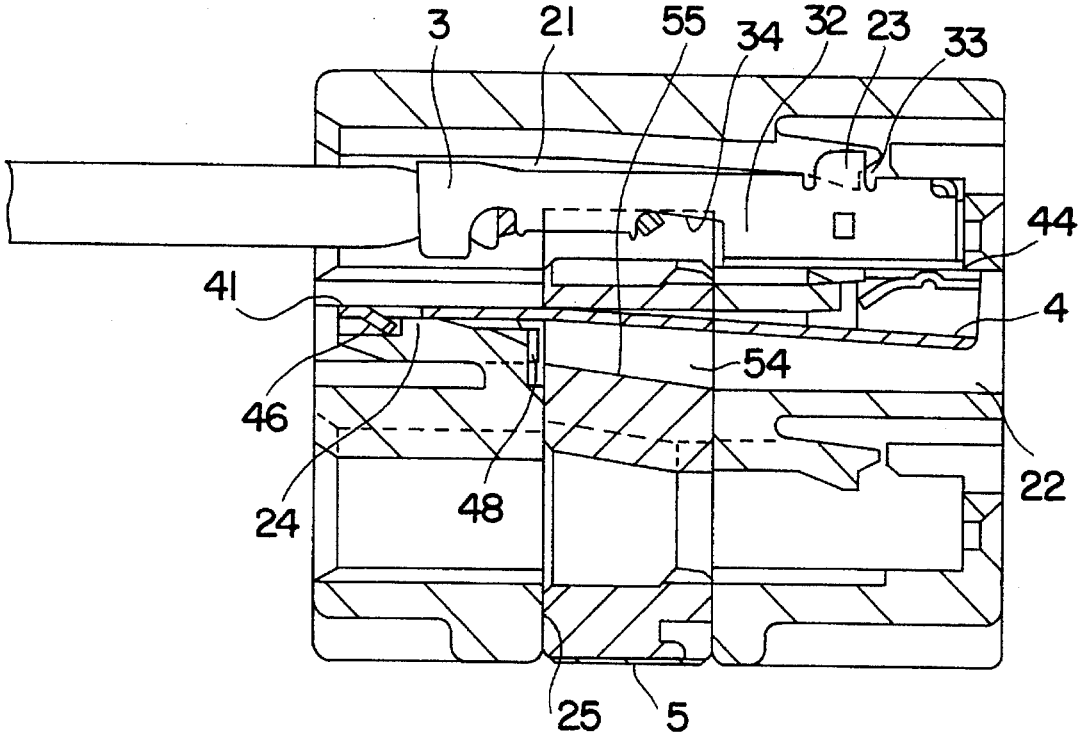
FIG. 6 is a section, similar to FIG. 2, of the apparatus side connector housing, in its temporary locking position.
Figure 7:
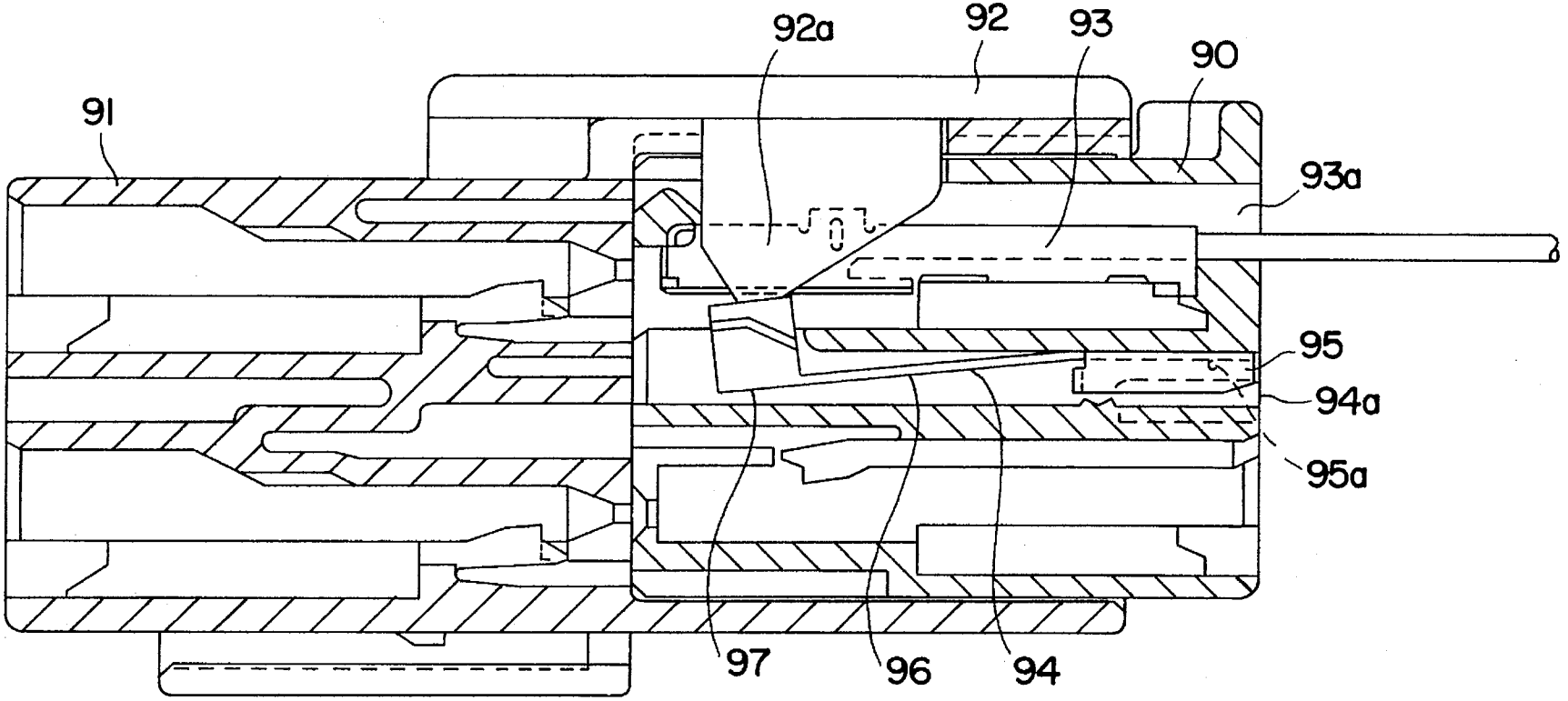
FIG. 7 PRIOR ART
FIG. 7 is a section of prior art connector.
Figure 8:
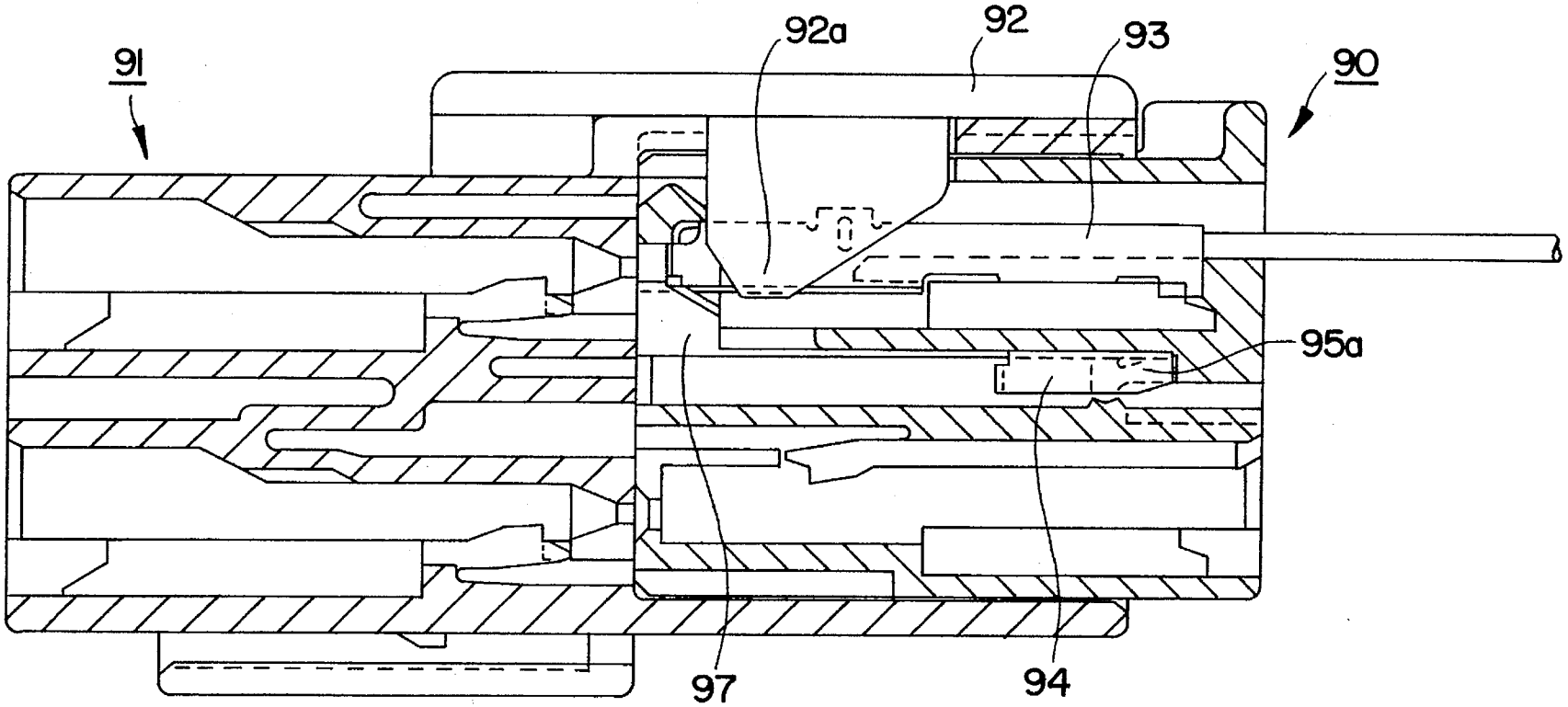
FIG. 8 PRIOR ART
FIG. 8 is a section of the prior art connector when insertion of a short-circuit terminal is insufficient.

A guide surface 55 is formed at the bottom surface of each insertion hole 54. The guide surface 55 is slanted such that its rear edge is located higher than its front edge. When the retainer 5 is in its temporary locking position, the lower edges of the front openings of the insertion holes 54 are substantially in flush with the lower surface of the cavity 22, as shown in FIG. 6, so that the leading end of the inserted short-circuit terminal 4 can be guided upward. Further, as shown in FIG. 2, when the retainer 5 is inserted further to the main locking position, the short-circuit terminal 4 is pressed and biased upward by the rear edge of the guide surface 55, with the result that the contact portions 44, 44 come into pressing contact with the lower surfaces of the supply terminals 3. Further, in the main locking position, the rear surface of the retainer 5 engages the outer surface of the second engaging projections 48 (second engagement).

Hereafter, the action of this embodiment is described.

The supply terminals 3 and the short-circuit terminal 4 are mounted in the housing main body 2 while the retainer 5 is locked in its temporary locking position, as shown in FIG. 6. When the supply terminals 3 are inserted into the cavities 21, the first engaging portions 33 are engaged with the engaging members 23, thereby realizing first engagement of the supply terminals 3. Thereafter, when the short-circuit terminal 4 is inserted into the cavity 22 from its front end, the supports 41 thereof are guided by the guide surfaces 55 in the insertion holes 54 and the first engaging projections 46 are engaged with the engaging members 24, thereby realizing first engagement of the short-circuit terminal 4.

After insertion of the supply terminals 3 and the short-circuit terminal 4, the retainer 5 is pressed further to the main locking position and locked. Thereby, the second engaging portions 53 project into the cavities 21 as shown in FIG. 2 and are engaged with the second engaging portions 34, with the result that the supply terminals 3 can be securely locked in the cavities 21, thereby realizing second engagement of the supply terminals 3. Further, in the cavity 22, the rear edges of the guide surfaces 55 move further upward, thereby pressing and biasing the short-circuit terminal 4 upward and bringing the contact portions 44 into pressing contact with the lower surfaces of the supply terminals 3. Simultaneously, the rear edges of the guide surfaces 55 come into engagement with the outer surfaces of the second engaging projections 48, thereby realizing second engagement of the short-circuit terminal 4, with the result that the short-circuit terminal 4 can be more securely locked in the cavity 22.

Particularly, in this embodiment, since the rear edges of the guide surfaces 55 are in pressing contact with the short-circuit terminal 4 while biasing the contact portions 44 upward, a contact between the supply terminals 3 and the short-circuit terminal 4 can be secured. Even if the apparatus side connector housing 1 is subjected to vibrations and impacts during transportation after being mounted in a wiring harness, the short-circuit terminal 4 can be securely retained in the cavity 22 without making any movement.

If one of the supply terminals 3 is insufficiently inserted into the cavities 21, not the second engaging portion 34 of this supply terminal 3, but the engaging portion 32 thereof is located in the mount hole 25. Accordingly, even if an attempt is made to press the retainer 5 to its main locking position, the upper surface of the retainer 5 comes into contact with the lower surface of the engaging portion 32, making it impossible to press the retainer 5 to its main locking position. Similarly, if the short-circuit terminal 4 is insufficiently inserted into the cavity 22, the second engaging projections 48 are located in the mount hole 25. If an attempt is made to press the retainer 5 to its main locking position, the guide surfaces 55 come into contact with the second engaging projections 48 and the retainer 5 cannot be pressed to its main locking position. Thus, when the retainer 5 cannot be pressed to the main locking position, it can be detected that insertion of the supply terminals 3 or short-circuit terminal 4 is improper. Then, the supply terminals 3 and the short-circuit terminal 4 are inserted again to mount them in their proper mounting positions.

The receptacle 64 of the supply side connector housing 6 then is engaged with the apparatus side connector housing 1. The coupling member 62 then is rotated about the fitting shafts 61 such that the pressing portion 66 passes through the groove 67 in the receptacle 64 and through the opening 26 in the main body 2 of the apparatus side connector housing 1. The pressing portion 66 then comes into pressing contact with the portion 45 on the short-circuit terminal 4, and thereby electrically separates the connecting portions 44 of the short-circuit terminal 4 from the short-circuited state with the supply terminals 3.

Although the foregoing embodiment is described with respect to a case where the short-circuit terminal 4 short-circuits the female supply terminals 3, the invention may also be applied to a case where male supply terminals are short-circuited.

Further, although the retainer 5 acts to lock both the supply terminals 3 and the short-circuit terminal 4 in the foregoing embodiment, there may be provided two separate retainers for locking supply terminals and for locking a short-circuit terminal.

What is claimed is:

1. A connector comprising:

a housing having a plurality of supply terminal cavities and at least one short-circuit terminal cavity, said housing further including a mount hole communicating with said supply terminal cavities and with said short-circuit terminal cavity;

a plurality of supply circuit terminals in the respective supply terminal cavities of the housing;

a short-circuit terminal in the short-circuit terminal cavity of the housing, said short-circuit terminal including a plurality of contact portions aligned respectively with the supply circuit terminals; and a retainer movable from a temporary locking position in said mount hole to a main locking position therein, said retainer having a locking means for locking engagement with said supply circuit terminals and with said short-circuit terminal when said retainer is in said main locking position, said retainer further having biasing means for pressing the contact portions of the short-circuit terminal into shorting electrical contact with the respective supply circuit terminals.

2. A connector according to claim 1, wherein the housing includes a top surface, a bottom surface and opposed front and rear ends extending between said top and bottom surfaces, said housing being formed to enable insertion of said supply terminals into the supply terminal cavities from the rear end of the housing and to enable insertion of said short-circuit terminal into the short-circuit terminal cavity from the front end of the housing.

3. A connector according to claim 2, wherein the supply terminal cavities and the short-circuit terminal cavity are substantially parallel.

4. A connector according to claim 2, wherein the mount hole extends into the bottom surface of the housing.

5. A connector according to claim 4, wherein the supply terminal cavities are intermediate the top surface and the short-circuit cavity.

6. A connector according to claim 1, wherein said housing includes a plurality of interior surfaces defining each of said supply terminal cavities, said locking means of said retainer comprising at least one surface substantially aligned with one of said interior surfaces defining each of said supply terminal cavities when said retainer is in said temporarily locking position such that said supply circuit terminals are insertable into said supply terminal cavities when said retainer is in said temporary locking position, said locking means of said retainer being disposed intermediate said interior surfaces of the respective supply terminal cavities when said retainer is in said main locking position in said housing for achieving said locking engagement with the supply terminals in the respective supply terminal cavities of the housing.

7. A connector according to claim 1, wherein said retainer includes at least one insertion hole passing therethrough, said insertion hole being dimensioned and disposed to substantially register with said short-circuit terminal cavity when said retainer is in said temporary locking position such that said short-circuit terminal is insertable into the short-circuit terminal cavity when said retainer is in said temporary locking position, said locking means further comprising portions of said retainer adjacent said insertion hole that is moved into said short-circuit cavity when said retainer is moved to the main locking position for achieving said locking engagement with the short-circuit terminal in said short-circuit terminal cavity.

8. A connector according to claim 7, wherein said retainer includes a guide surface defining a portion of said insertion hole, said guide surface defining said biasing means for pressing the contact portions of said short-circuit terminal into shorting electrical contact with said supply circuit terminals when said retainer is in said main locking portion.

9. A connector according to claim 1, wherein said retainer includes at least one insertion hole passing therethrough, said insertion hole being dimensioned and disposed to substantially register with said short-circuit terminal cavity when said retainer is in said temporary locking position such that said short-circuit terminal is insertable into the short-circuit terminal cavity when said retainer is in said temporary locking position, said locking means comprising portions of said retainer adjacent said insertion hole that is moved into said short-circuit cavity when said retainer is moved to the main locking position for achieving said locking engagement with the short-circuit terminal in said short-circuit terminal cavity.

10. A connector according to claim 9, wherein said retainer includes a guide surface defining a portion of said insertion hole, said guide surface defining said biasing means for pressing the contact portions of said short-circuit terminal into shorting the electrical contact with said supply circuit terminals when said retainer is in said main locking portion.

11. A connector according to claim 1, further comprising a pressing portion for selectively pressing portions of said short-circuit terminal in proximity to said contact portions for electrically separating the contact portions of the short-circuit terminal from the supply terminals.

* * * * *